US010873823B2

(12) United States Patent
Miyasaka

(10) Patent No.: US 10,873,823 B2
(45) Date of Patent: Dec. 22, 2020

(54) SOUND PROCESSING DEVICE AND SOUND PROCESSING METHOD

(71) Applicant: SOCIONEXT INC., Kanagawa (JP)

(72) Inventor: Shuji Miyasaka, Yokohama (JP)

(73) Assignee: SOCIONEXT INC., Kanagawa (JP)

( * ) Notice: Subject to any disclaimer, the term of this patent is extended or adjusted under 35 U.S.C. 154(b) by 0 days.

(21) Appl. No.: 16/675,018

(22) Filed: Nov. 5, 2019

(65) Prior Publication Data

US 2020/0068333 A1 Feb. 27, 2020

Related U.S. Application Data

(63) Continuation of application No. PCT/JP2018/012070, filed on Mar. 26, 2018.

(30) Foreign Application Priority Data

May 9, 2017 (JP) ..... 2017-093170

(51) Int. Cl.
*H04S 7/00* (2006.01)
*H04R 5/02* (2006.01)
(Continued)

(52) U.S. Cl.
CPC ..... *H04S 7/301* (2013.01); *H04R 5/02* (2013.01); *H04R 5/027* (2013.01); *H04R 5/04* (2013.01); *H04S 3/008* (2013.01); *H04R 2499/11* (2013.01); *H04R 2499/15* (2013.01); *H04S 2400/01* (2013.01); *H04S 2400/15* (2013.01)

(58) Field of Classification Search
CPC ..... H04S 7/301; H04S 3/008; H04S 2400/01; H04S 2400/15; H04R 5/02; H04R 5/027; H04R 5/04; H04R 2499/11; H04R 2499/15
See application file for complete search history.

(56) References Cited

U.S. PATENT DOCUMENTS

| | | | | |
|---|---|---|---|---|
| 9,271,076 | B2 * | 2/2016 | Heiman | H04R 5/027 |
| 2016/0295342 | A1 | 10/2016 | Miyasaka et al. | |
| 2018/0192223 | A1 * | 7/2018 | Satheesh | H04S 7/301 |

FOREIGN PATENT DOCUMENTS

| | | | |
|---|---|---|---|
| CN | 1212599 | A | 3/1999 |
| GB | 2329747 | A | 3/1999 |

(Continued)

OTHER PUBLICATIONS

Fujita et al., "Surround sound mixing apparatus and program for same"—Google Patents translation, Feb. 9, 2004, pp. 1-10 (Year: 2004).*

(Continued)

*Primary Examiner* — Regina N Holder
(74) *Attorney, Agent, or Firm* — McDermott Will & Emery LLP

(57) ABSTRACT

A sound processing device includes: a distance information obtaining unit which obtains information about a first distance between stereo microphones and information about a second distance between stereo loudspeakers; and a signal processing unit which processes a stereophonic audio signal collected by the stereo microphones according to the first distance and the second distance to adjust a stereo effect provided when the stereophonic audio signal is reproduced from the stereo loudspeakers.

16 Claims, 11 Drawing Sheets

(51) Int. Cl.

| | |
|---|---|
| ***H04R 5/027*** | (2006.01) |
| ***H04R 5/04*** | (2006.01) |
| ***H04S 3/00*** | (2006.01) |

(56) References Cited

FOREIGN PATENT DOCUMENTS

| | | |
|---|---|---|
| JP | 2005-223771 A | 8/2005 |
| WO | 2015/087490 A1 | 6/2015 |

OTHER PUBLICATIONS

International Search Report and Written Opinion dated Jun. 5, 2018 in International Application No. PCT/JP2018/012070; with partial English translation.

Chinese Office Action and Search Report dated Sep. 2, 2020 for the corresponding Chinese Patent Application No. 201880029474.5; with partial English translation.

* cited by examiner

FIG. 2

| Event type | Length in offensive and defensive direction | MD |
|---|---|---|
| Basketball | 28 m | 30 m |
| Volleyball | 18 m | 20 m |
| Tennis | 23.77 m | 25 m |
| Badminton | 13.4 m | 15 m |
| Handball | 40 m | 45 m |
| Soccer | 120 m | 130 m |
| Table tennis | 2.74 m | 2.5 m |
| Sumo | 6.7 m | 7 m |
| Boxing | 6 m | 7 m |

$\theta_{SL} = \tan^{-1}((SD / 2) / SLD)$

SOUND PROCESSING DEVICE AND SOUND PROCESSING METHOD

CROSS REFERENCE TO RELATED APPLICATIONS

This is a continuation application of PCT International Application No. PCT/JP2018/012070 filed on Mar. 26, 2018, designating the United States of America, which is based on and claims priority of Japanese Patent Application No. 2017-093170 filed on May 9, 2017. The entire disclosures of the above-identified applications, including the specifications, drawings and claims are incorporated herein by reference in their entirety.

FIELD

The present disclosure relates to a sound processing device and a sound processing method which process a stereophonic audio signal.

BACKGROUND

In recent years, not only TV broadcasting, but also relay broadcasting of various sporting events using the Internet as a transmission medium have been widely used. In such Internet broadcasting, an audio signal of various sporting events is collected, and the audio signal is reproduced by various devices connectable to the Internet. In other words, in the Internet broadcasting of sporting events, the audio signal collected in various sound collection environments is reproduced in various reproduction environments.

Patent Literature (PTL) 1 discloses a technique which virtually provides a stereophonic sound field to a listener by using two speakers.

CITATION LIST

Patent Literature

PTL 1: International Application Publication No. WO2015/087490

SUMMARY

Technical Problem

As described above, in the Internet broadcasting of sporting events, since the audio signal collected in various sound collection environments is reproduced in various reproduction environments, it is difficult to realize realistic sound reproduction.

In view of the above, the present disclosure provides a sound processing device or a sound processing method capable of realizing realistic sound reproduction suitable for the sound collection environment and the reproduction environment.

Solution to Problem

A sound processing device according to one aspect of the present disclosure includes: an obtaining unit which obtains information about a first distance between stereo microphones and information about a second distance between stereo loudspeakers; and a signal processing unit which processes a stereophonic audio signal according to the first distance and the second distance to adjust a stereo effect provided when the stereophonic audio signal is reproduced from the stereo loudspeakers, the stereophonic audio signal being collected by the stereo microphones.

General and specific aspects disclosed above may be implemented using a system, a method, an integrated circuit, a computer program, or a computer-readable recording medium such as a CD-ROM, or any combination of systems, methods, integrated circuits, computer programs, or computer-readable recording media.

Advantageous Effects

A sound processing device or a sound processing method according to one aspect of the present disclosure is capable of realizing realistic sound reproduction suitable for the sound collection environment and the reproduction environment.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

FIG. 2 is a table indicating a relationship between sporting events and sound collection environments according to Embodiment 1.

Figure 1:
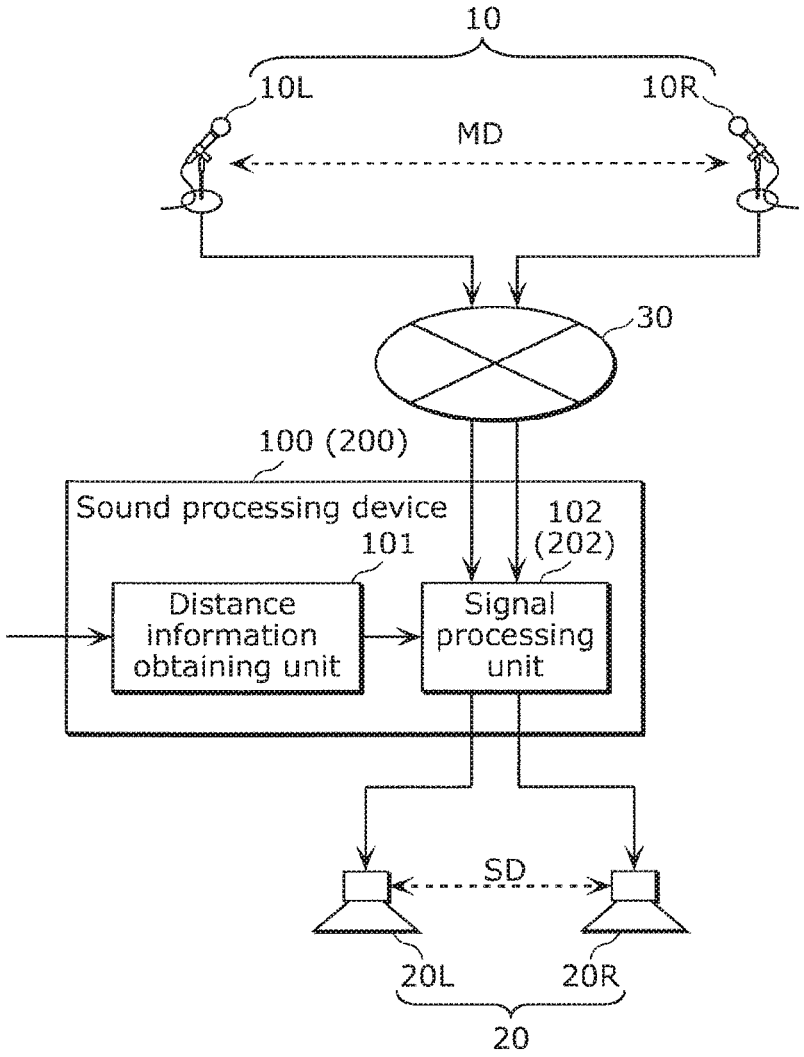
FIG. 1 is a block diagram illustrating a sound processing system according to Embodiments 1 and 2.

DESCRIPTION OF EMBODIMENTS (Underlying Knowledge Forming Basis of the Present Disclosure)

Sense of realism in sport broadcasting is considered to be enhanced by the characteristic sound of the sporting event being heard from the direction in which the sound is being generated. The characteristic sound of the sporting event is often generated at both the offensive and defensive ends.

However, even if the sound of the event is collected by arranging stereo microphones at both the offensive and defensive ends, mobile terminals and home television receivers are unlikely to reproduce realistic sound. This is because the distance between the stereo speakers of the mobile terminals and the home television receivers is significantly less than the distance between both the offensive and defensive ends of the sporting event (that is, the distance between the stereo microphones), which impairs the spread of the original sound.

In contrast, when sound is reproduced in a public viewing venue or the like, the distance between the stereo speakers may be greater than the distance between both the offensive and defensive ends of the sporting event. Since the original sound field is impaired in this case, too, realistic sound reproduction is difficult.

In view of the above, the sound processing device according to one aspect of the present disclosure realizes realistic sound reproduction by adjusting the stereo effect through processing of the stereophonic audio signal based on the distance between the stereo microphones and the distance between the stereo speakers.

Hereinafter, embodiments will be specifically described with reference to the drawings.

Each embodiment described below shows a general or specific example. The numerical values, shapes, materials, structural elements, the arrangement and connection of the structural elements, steps, the processing order of the steps etc. shown in the following embodiments are mere examples, and therefore do not limit the scope of the Claims. Among the structural elements in the following embodiments, structural elements not recited in any one of the independent claims defining the most generic concept are described as optional structural elements.

Note that the drawings are not necessarily precise illustrations. Like reference signs indicate like elements in the drawings, and overlapping descriptions thereof are omitted or simplified.

Embodiment 1

First, Embodiment 1 will be described. In the present embodiment, the stereo effect is adjusted by the magnitude of a left-channel signal reaching the right ear and the magnitude of a right-channel signal reaching the left ear. In other words, the stereo effect is adjusted by the amount of crosstalk components. A sound processing device and a sound processing method related to such adjustment of the stereo effect will be described below.

[Configuration of Sound Processing System]

FIG. 1 is a functional block diagram of a sound processing system including a sound processing device 100 according to Embodiment 1. The sound processing system in FIG. 1 includes stereo microphones 10, stereo speakers 20, and the sound processing device 100.

[Stereo Microphones]

Stereo microphones 10 collect a stereophonic audio signal including a right-channel signal and a left-channel signal. The stereo microphones 10 include a left microphone 10L and a right microphone 10R.

The left microphone 10L and the right microphone 10R are arranged apart from each other by a first distance (hereinafter, also referred to as MD). The stereophonic audio signal collected by the stereo microphones 10 is transmitted to the sound processing device 100 via a medium 30. The medium 30 may be a transmission medium (such as Internet connection or broadcast waves), or may be a recording medium (such as an optical disk or a semiconductor memory).

In a sporting event, characteristic sound of the event is often generated at both the offensive and defensive ends. Accordingly, in relay broadcasting of a sporting event, stereo microphones 10 may be arranged near both the offensive and defensive ends (for example, the end lines in basketball). When the stereo microphones 10 are arranged in such a manner, MD differs depending on the type of sporting event.

FIG. 2 is a table of an example of a relationship between event type, length of the offensive and defensive direction, and MD. The offensive and defensive direction refers to the direction along which offensive players and defensive players face each other in a sporting event. When the playing area has a rectangular shape, the offensive and defensive direction often coincides with the longitudinal direction of the playing area.

In FIG. 2, MD is predetermined according to the length of the offensive and defensive direction in the playing area of the sporting event. For example, in basketball, the length of the offensive and defensive direction is about 28 m, and MD is about 30 m. In table tennis, the offensive and defensive direction is about 2.74 m, and MD is about 2.5 m.

Figure 3:
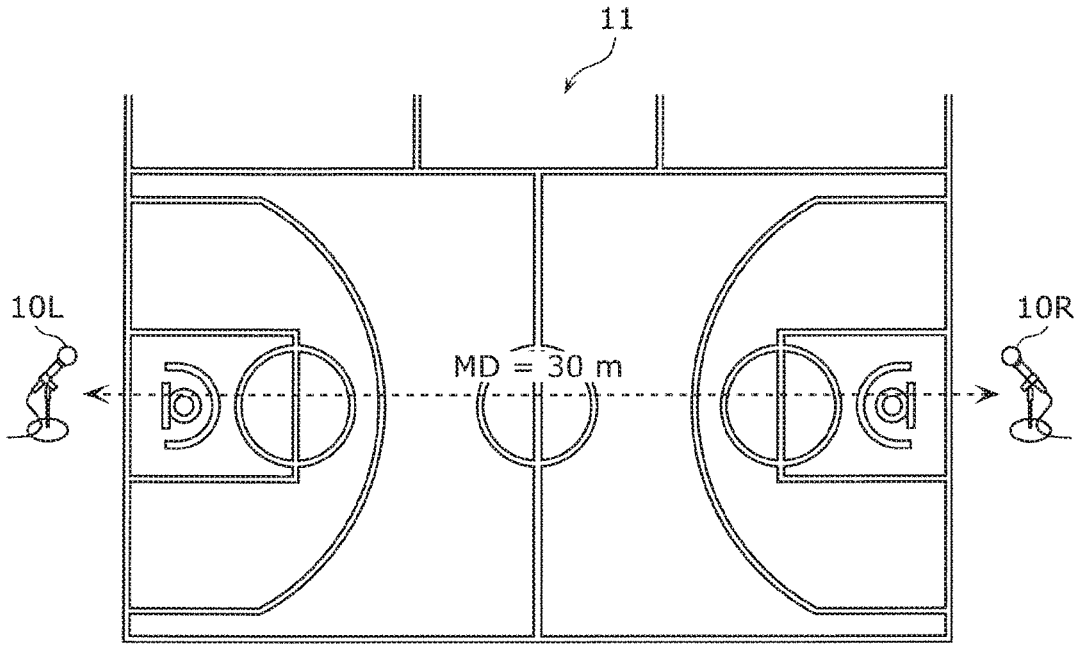
FIG. 3 illustrates an example of MD according to Embodiment 1.
Figure 4:
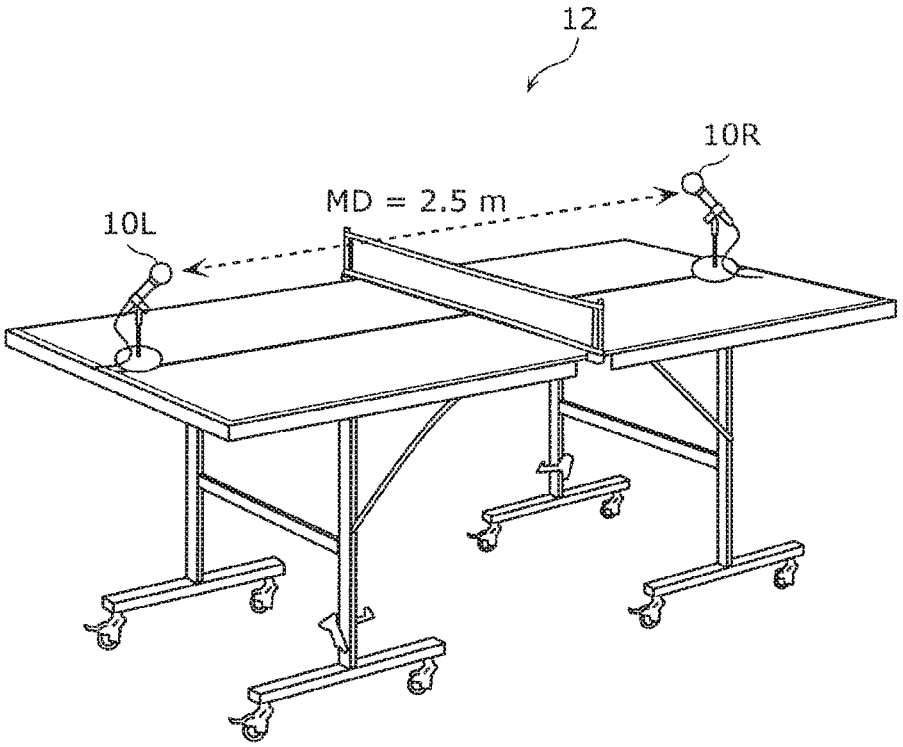
FIG. 4 illustrates another example of MD according to Embodiment 1.

Here, MD will be described in more detail. FIG. 3 illustrates an example of MD according to Embodiment 1. Specifically, FIG. 3 illustrates an example of arrangement of the stereo microphones 10 in basketball. FIG. 4 illustrates another example of MD according to Embodiment 1. Specifically, FIG. 4 illustrates an example of arrangement of the stereo microphones 10 in table tennis.

In basketball, as illustrated in FIG. 3, the left microphone 10L and the right microphone 10R are arranged outside the playing area 11 and near the end lines. In this case, MD (about 30 m) is slightly greater than the length of the playing area in the offensive and defensive direction (about 28 m).

In table tennis, as illustrated in FIG. 4, the left microphone 10L and the right microphone 10R are arranged near the short sides of a table tennis table 12, and is, for example, embedded in the table tennis table 12. In this case, MD (about 2.5 m) is slightly less than the length of the playing area in the offensive and defensive direction (about 2.74 m).

[Stereo Speakers]

The stereo speakers 20 reproduce the stereophonic audio signal of the sporting event processed by the sound processing device 100. The stereo speakers 20 include a left speaker 20L and a right speaker 20R. The left speaker 20L and the right speaker 20R are arranged apart from each other by a second distance (hereinafter, also referred to as SD).

Figure 5:
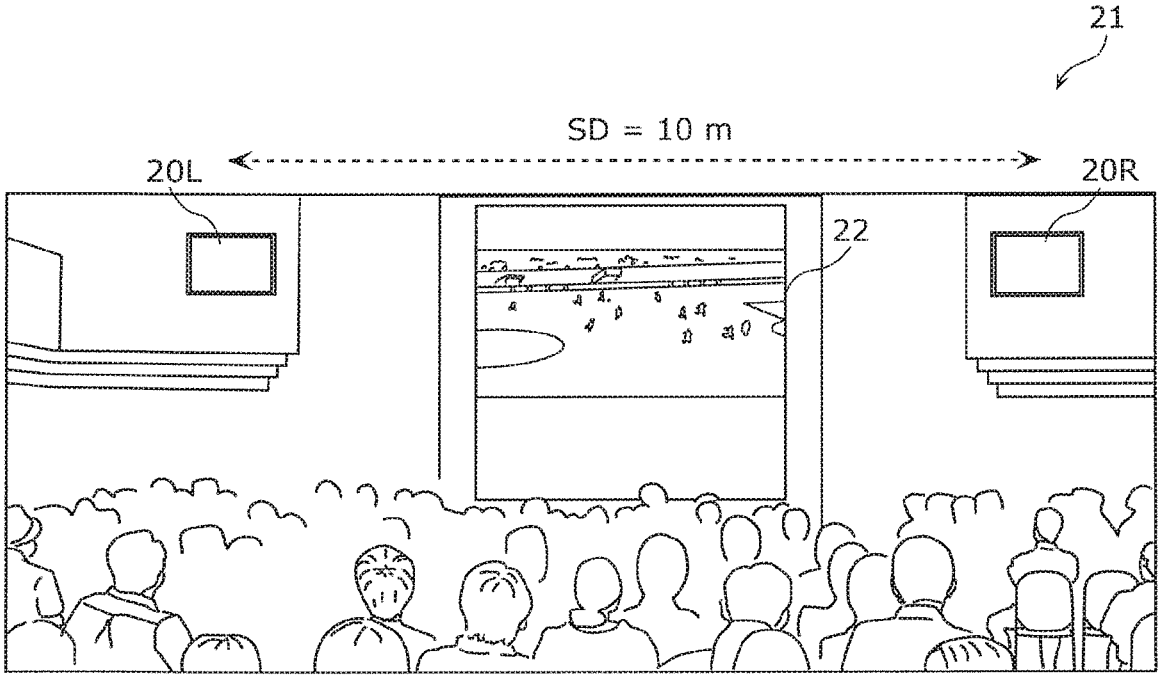
FIG. 5 illustrates an example of SD according to Embodiment 1.
Figure 6:
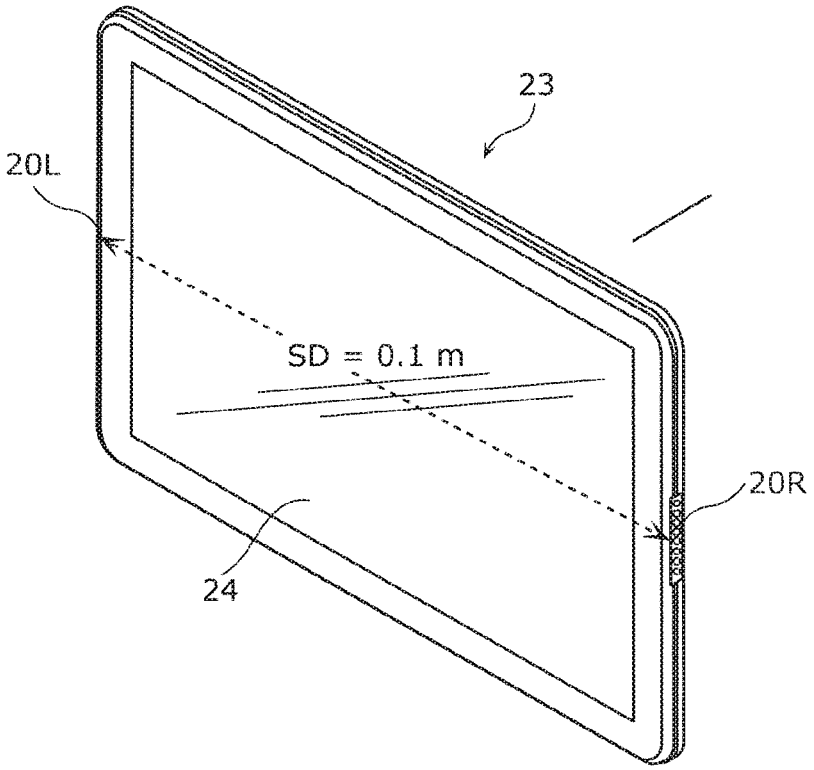
FIG. 6 illustrates another example of SD according to Embodiment 1.
Figure 7:
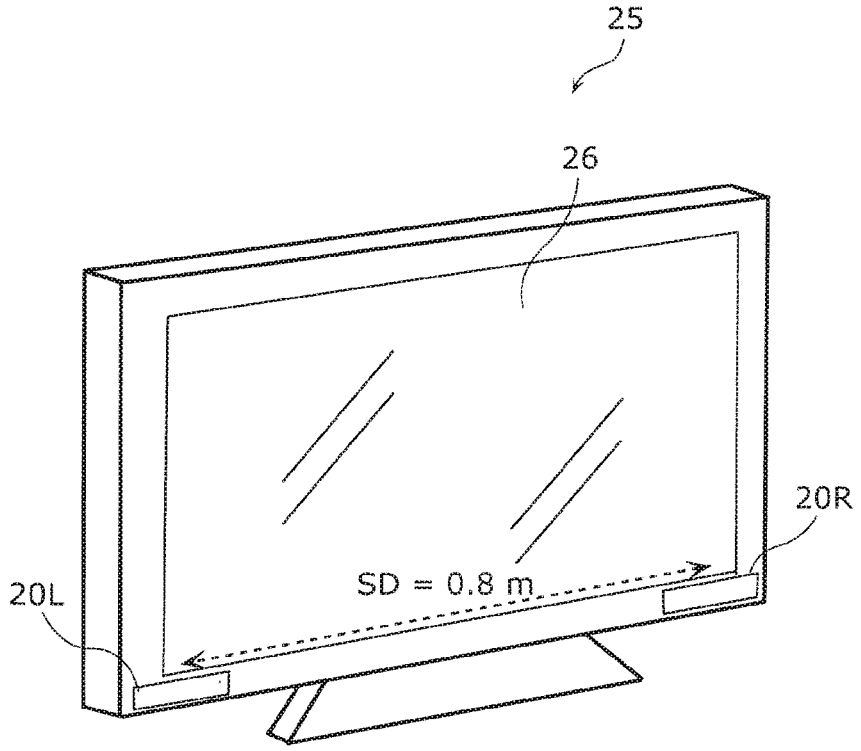
FIG. 7 illustrates another example of SD according to Embodiment 1.

Here, SD will be described in more detail. FIG. 5 illustrates an example of SD according to Embodiment 1. Specifically, FIG. 5 illustrates an example of an arrangement of the stereo speakers 20 in a public viewing venue. FIG. 6 illustrates another example of SD according to Embodiment 1. Specifically, FIG. 6 illustrates an example of an arrangement of the stereo speakers 20 in a mobile terminal. FIG. 7 illustrates another example of SD according to Embodiment 1. Specifically, FIG. 7 illustrates an example of an arrangement of the stereo speakers 20 in a home television receiver.

As illustrated in FIG. 5, an image is displayed on a large screen 22 in the public viewing venue 21. The left speaker 20L and the right speaker 20R are arranged across the large screen 22. In the public viewing venue 21 according to the present embodiment, SD is set to about 10 m.

As illustrated in FIG. 6, the mobile terminal 23 includes a display 24, the left speaker 20L and the right speaker 20R. The mobile terminal 23 is, for example, a smart phone or a tablet computer. The left speaker 20L and the right speaker 20R are arranged across the display 24. In the mobile terminal 23 according to the present embodiment, SD is set to about 0.1 m.

As illustrated in FIG. 7, the television receiver 25 includes a display 26, the left speaker 20L, and the right speaker 20R. The left speaker 20L and the right speaker 20R are arranged below display 26 and near the horizontal ends of display 26. In television receiver 25 according to the present embodiment, SD is set to about 0.8 m.

[Sound Processing Device]

The sound processing device 100 processes a stereophonic audio signal, and outputs the processed stereophonic audio signal to the stereo speakers. The sound processing device 100 includes a distance information obtaining unit 101, and a signal processing unit 102.

The distance information obtaining unit 101 obtains information about the first distance (MD) between the stereo microphones and information about the second distance (SD) between the stereo speakers. For example, the distance information obtaining unit 101 may obtain the information about the first distance and the information about the second distance from the listener via a user interface. For example, the distance information obtaining unit 101 may obtain the information about the first distance via the medium 30. In this case, the information about the first distance may be multiplexed into a stereophonic audio signal, or may be multiplexed as an attribute of a broadcast (or distribution) program content.

The information about the first distance and the information about the second distance may respectively include the value of the first distance and the value of the second distance, or may include the value of ratio between the first distance and the second distance. Moreover, the information about the first distance and the information about the second distance may include information indicating the type of the sporting event, and information indicating the type of the reproduction device. In this case, the distance information obtaining unit 101 may store, in advance, event distance information associating the event type and the first distance, as illustrated in FIG. 2, and device distance information associating the device type and the second distance. The distance information obtaining unit 101 may refer to the information to obtain the first distance and the second distance corresponding to the event type and the device type included in the information about the first distance and the information about the second distance.

The signal processing unit 102 processes the stereophonic audio signal collected by the stereo microphones 10 according to the first distance (MD) and the second distance (SD), to adjust the stereo effect provided when the stereophonic audio signal is reproduced from the stereo speakers 20. Specifically, the signal processing unit 102 performs, on the stereophonic audio signal, first signal processing for increasing the stereo effect, when the value of the ratio of the second distance to the first distance (SD/MD) is less than a threshold value (Th). The signal processing unit 102 performs, on the stereophonic audio signal, second signal processing for reducing the stereo effect, when the value of the ratio of the second distance to the first distance (SD/MD) is greater than the threshold value (Th). When the value of the ratio of the second distance to the first distance (SD/MD) is equal to the threshold value (Th), the signal processing unit 102 may perform either the first signal processing or the second signal processing on the stereophonic audio signal, or may perform none of the first signal processing and the second signal processing.

Here, a predetermined value close to "1" may be used as the threshold value Th. As the value close to "1", a value greater than or equal to 0.5 and less than or equal to 1.5 may be used. For example, when "1" is used as the threshold value Th, the first signal processing is performed when the relation of SD/MD<1 (i.e. MD>SD) is satisfied, and the second signal processing is performed when the relation of SD/MD>1 (i.e. MD<SD) is satisfied.

In the present embodiment, the first signal processing attenuates the crosstalk components of the sound output from the stereo speakers 20, and the second signal processing amplifies the crosstalk components of the sound output from the stereo speakers 20. The first signal processing and the second signal processing will be later described in detail with reference to the drawings.

[Operation of Sound Processing Device]

Figure 8:
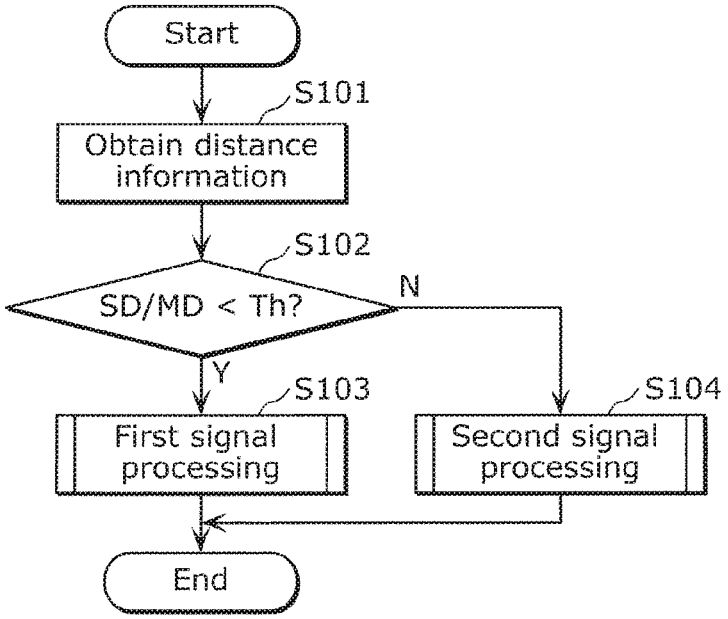
FIG. 8 is a flowchart of a processing operation performed by the sound processing device according to Embodiment 1.

Next, an operation of the sound processing device 100 configured as described above will be described. FIG. 8 is a flowchart of a processing operation performed by the sound processing device 100 according to Embodiment 1.

First, the distance information obtaining unit 101 obtains information about the first distance and information about the second distance (S101). Next, the signal processing unit 102 compares SD/MD with Th (S102). Here, when SD/MD is less than Th (Y in S102), the signal processing unit 102 performs the first signal processing on the stereophonic audio signal (S103). In contrast, when SD/MD is greater than or equal to Th (N in S102), the signal processing unit 102 performs the second signal processing on the stereophonic audio signal (S104).

[First Signal Processing]

Figure 9:
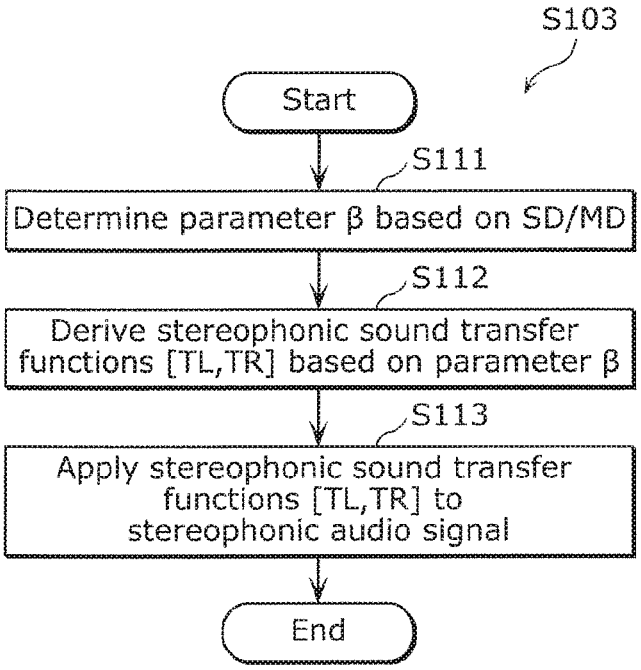
FIG. 9 is a flowchart of first signal processing according to Embodiment 1.

Here, the first signal processing will be specifically described with reference to FIG. 9 to FIG. 12. FIG. 9 is a flowchart of the first signal processing (S103) according to Embodiment 1.

As illustrated in FIG. 9, first, the signal processing unit 102 determines a parameter β for the first signal processing, based on SD/MD (S111). The signal processing unit 102 derives stereophonic sound transfer functions [TL, TR] based on the determined parameter β (S112). Finally, the signal processing unit 102 applies the stereophonic sound transfer functions [TL, TR] to a stereophonic audio signal (S113).

Figure 10:
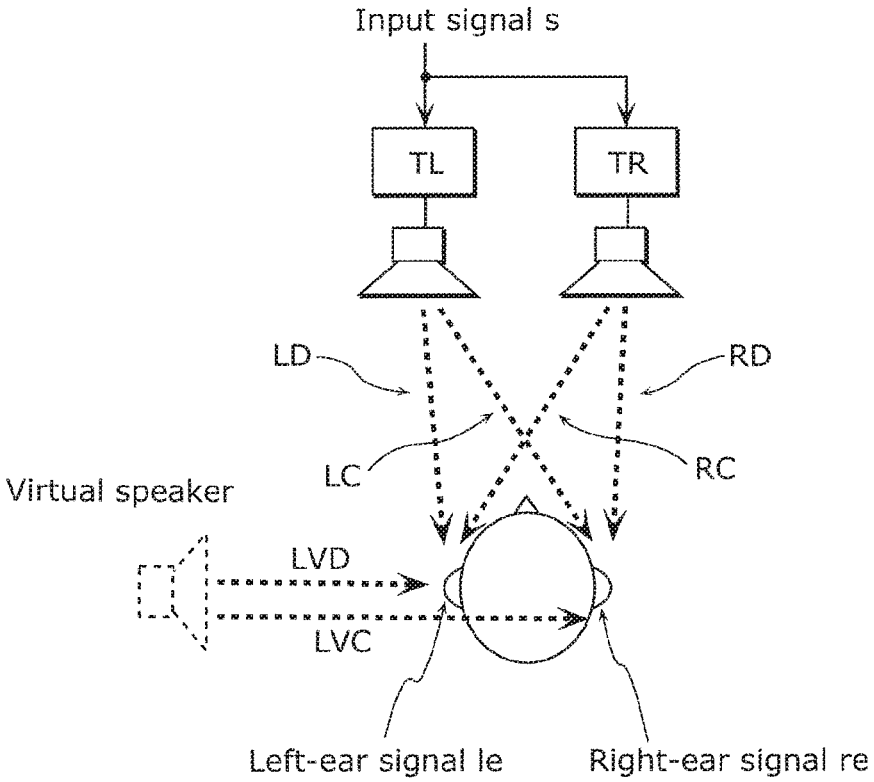
FIG. 10 illustrates principles of the first signal processing according to Embodiment 1.

Here, the parameter β and the stereophonic sound transfer functions [TL, TR] will be described with reference to FIG. 10 and FIG. 11. FIG. 10 illustrates the principles of the first signal processing according to Embodiment 1.

In FIG. 10, LD and LC represent the transfer functions of the sound reaching the left ear and the right ear of the listener from the left speaker, and RD and RC represent the transfer functions of the sound reaching the right ear and the left ear of the listener from the right speaker. Moreover, LVD represents the transfer function of the sound reaching the left ear of the listener from a virtual speaker (virtual sound source), and LVC represents the transfer function of the sound reaching the right ear of the listener from the same virtual speaker. Here, the position of the virtual speaker is fixed to the left direction of 90 degrees with respect to the front direction of the face of the listener.

Formula 1 indicates target characteristics of the audio signal reaching the left ear and the right ear of the listener in FIG. 10. Specifically, Formula 1 indicates the target characteristics to make a left-ear signal le reach the left ear from the virtual speaker and to make a right-ear signal re reach the right ear from the virtual speaker. The left-ear signal le is the result of multiplying an input signal s by the transfer function LVD. The right-ear signal re is the result of multiplying an input signal s by the transfer function LVC.

[Math 1]

$$\begin{pmatrix} s \times LVD \times \alpha \\ s \times LVC \times \beta \end{pmatrix} = \begin{pmatrix} LD & RC \\ LC & RD \end{pmatrix} \times \begin{pmatrix} TL \\ TR \end{pmatrix} \times (s) \qquad \text{Formula 1}$$

Here, α and β are parameters for controlling the magnitude of the audio signal reaching the left and right ears. Specifically, α is a coefficient for adjusting the magnitude of the left-ear signal le reaching the left ear, and β is a coefficient for adjusting the magnitude of the right-ear signal re reaching the right ear.

By modifying Formula 1, the stereophonic sound transfer functions [TL, TR] are expressed as in Formula 2. In Formula 2, the stereophonic sound transfer functions [TL, TR] are obtained by multiplying the inverse matrix of the determinant of the transfer functions of spatial sound by the constant sequences of [LVD×α, LVC×β].

[Math 2]

$$\begin{pmatrix} TL \\ TR \end{pmatrix} = \begin{pmatrix} LD & RC \\ LC & RD \end{pmatrix}^{-1} \times \begin{pmatrix} LVD \times \alpha \\ LVC \times \beta \end{pmatrix} \qquad \text{Formula 2}$$

Here, when α is sufficiently greater than β, the magnitude of the left-ear signal le reaching the left ear is sufficiently greater than the magnitude of the right-ear signal re reaching the right ear. In other words, a left-ear signal le with a large magnitude reaches the left ear, and hardly any right-ear signal re reaches the right ear. In this case, when a left-channel signal is used as an input signal s, a left-channel signal with a larger magnitude reaches the left ear compared to the right ear. In other words, the stereo effect increases because the amount of crosstalk components is reduced.

In contrast, when α and β are substantially the same, the magnitude of the left-ear signal le reaching the left ear is substantially the same as the magnitude of the right-ear signal re reaching the right ear. Accordingly, in this case, when a left-channel signal is used as an input signal s, a left-channel signal with a large magnitude reaches the right ear, too. In other words, the stereo effect does not increase because the amount of crosstalk components is not reduced.

Here, when defining $\alpha=1-\beta$ ($0\leq\beta\leq0.5$), the stereo effect increases as β decreases from 0.5. In the present embodiment, the stereo effect is adjusted by adjusting parameters β for the first signal processing according to SD/MD.

Figure 11:
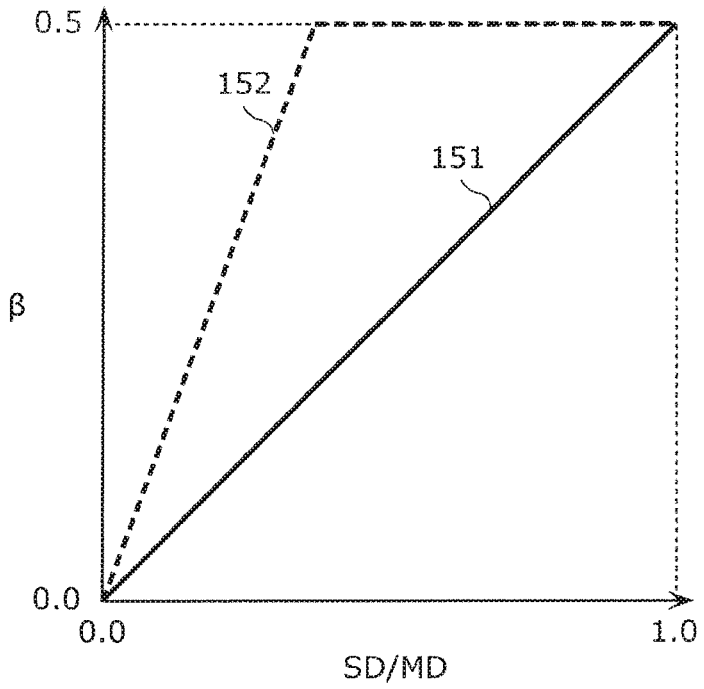
FIG. 11 is a graph of an example of a relationship between SD/MD and parameter β used for the first signal processing according to Embodiment 1.

FIG. 11 is a graph of an example of a relationship between SD/MD and parameter β for the first signal processing according to Embodiment 1. In FIG. 11, the horizontal axis represents the value of SD/MD, and the vertical axis represents the value of parameter β. As the relationship between SD/MD and β, two examples of a line 151 and a line 152 are illustrated.

In the line 151, β and SD/MD are in direct proportion. When SD/MD is "0", β is "0", and when SD/MD is "1", β is "0.5".

In contrast, in the line 152, when SD/MD is less than a ($0<a<1$), β and SD/MD are in direct proportion, and when SD/MD is greater than or equal to a, β takes a constant value (0.5) regardless of SD/MD. In this case, when SD is ensured to be a predetermined distance or greater, the stereo effect is not particularly emphasized.

In both cases of the lines 151 and 152, β is monotonically non-decreasing (monotonically increasing in a broad sense) with respect to SD/MD. In this case, as SD/MD decreases, the crosstalk components of the sound output from the stereo speakers 20 can be attenuated, leading to an increase in stereo effect.

The signal processing unit 102 determines, in step S111 in FIG. 9, the parameter β based on the predetermined relationship between β and SD/MD (such as lines 151 and 152).

The relationship between β and SD/MD is not limited to the relationship in FIG. 9. For example, the relationship between 13 and SD/MD may be represented by a step function. The relationship between β and SD/MD may be stored in any form. For example, the relationship between β and SD/MD may be stored in the form of formulas, or in a table format.

For example, when a stereophonic audio signal collected at a basketball event is reproduced in a public viewing venue, 0.33 (=10/30) is obtained as SD/MD. In this case, since SD/MD is less than 1 (threshold value), the signal processing unit 102 refers to, for example, the line 151 to determine $\beta=0.165$ corresponding to SD/MD=0.33 and further determine $\alpha=1-\beta=0.835$.

In step S112 in FIG. 9, the signal processing unit 102 derives the stereophonic sound transfer functions [TL, TR] according to Formula 2, by using the parameter determined based on SD/MD. The signal processing unit 102 then applies the derived transfer functions [TL, TR] to a stereophonic audio signal in step S113 in FIG. 9.

Figure 12:
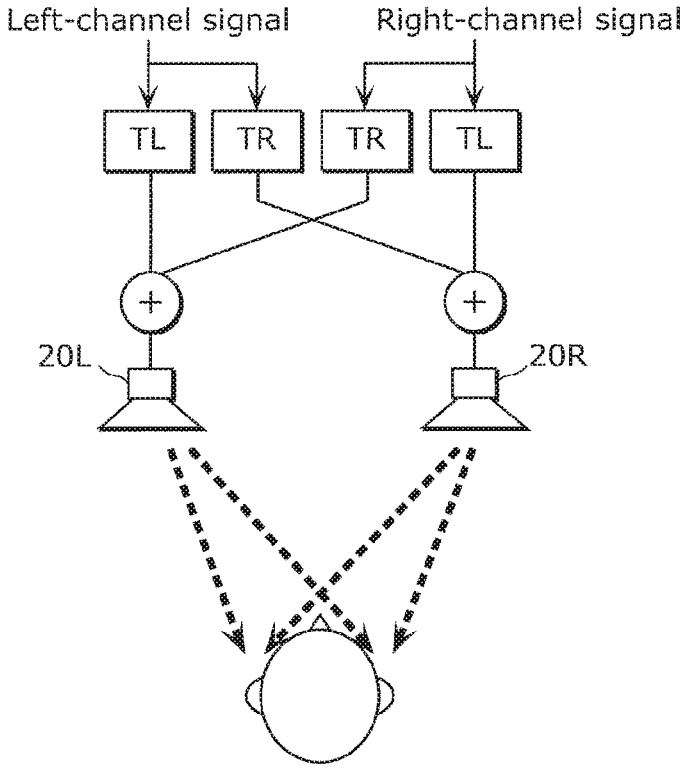
FIG. 12 illustrates the first signal processing according to Embodiment 1.

Application of the transfer functions [TL, TR] to a stereophonic audio signal will be described with reference to FIG. 12. FIG. 12 illustrates the first signal processing according to Embodiment 1. Specifically, FIG. 12 illustrates application of the transfer functions [TL, TR] to a stereophonic audio signal.

As illustrated in FIG. 12, for the left speaker 20L, the signal processing unit 102 applies the transfer function TL to a left-channel signal and applies the transfer function TR to a right-channel signal. Sound is output from the left speaker 20L based on the signals applied in such a manner. Moreover, for the right speaker 20R, the signal processing unit 102 applies the transfer function TL to a right-channel signal, and applies the transfer function TR to a left-channel signal.

Sound is output from the right speaker 20R based on the signals applied in such a manner. Accordingly, a three-dimensional sound field is realized in which a stereophonic audio signal reaches the left ear and the right ear of the listener from the virtual sound sources to the left and right of the listener.

[Second Signal Processing]

Figure 13:
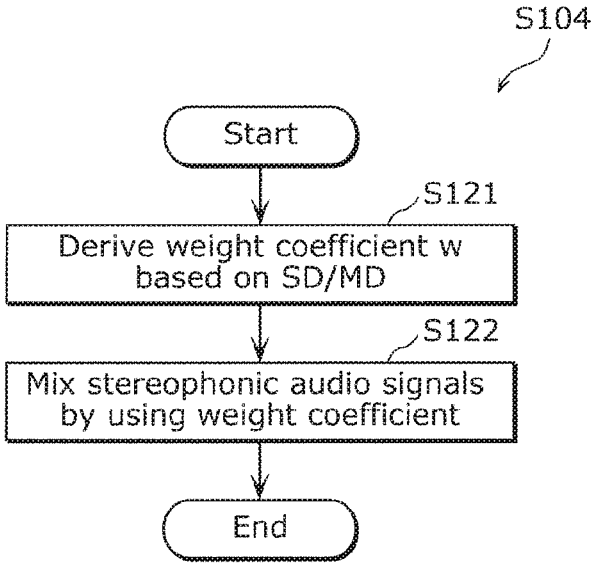
FIG. 13 is a flowchart of second signal processing according to Embodiment 1.
Figure 14:
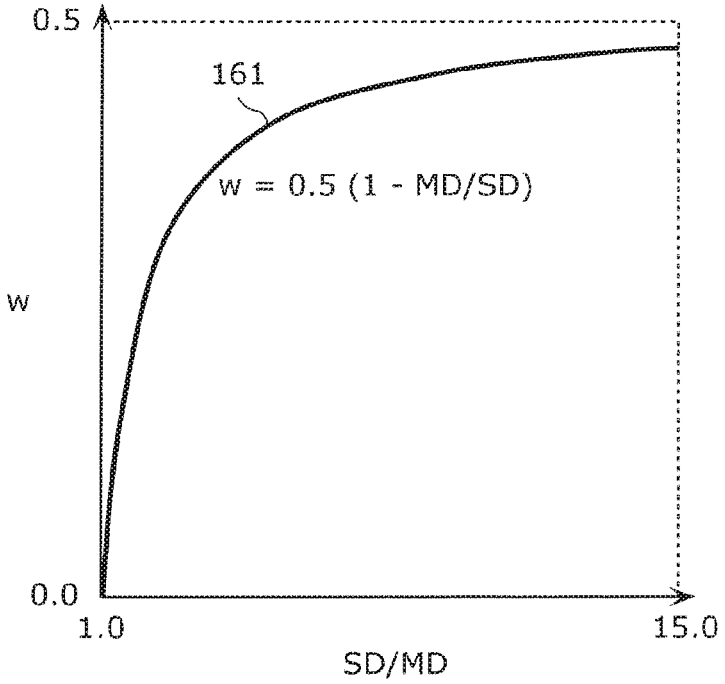
FIG. 14 is a graph of an example of a relationship between SD/MD and parameter used for the second signal processing according to Embodiment 1.

Next, the second signal processing will be specifically described with reference to FIG. 13 to FIG. 15. FIG. 13 is a flowchart of the second signal processing (S104) according to Embodiment 1.

As illustrated in FIG. 13, first, the signal processing unit 102 derives a weight coefficient w which is a parameter for the second signal processing, based on SD/MD (S121).

Here, the relationship between SD/MD and weight coefficient w will be described with reference to FIG. 14. FIG. 14 is a graph of an example of a relationship between SD/MD and parameter for the second signal processing according to Embodiment 1. In FIG. 14, the horizontal axis indicates SD/MD, and the vertical axis indicates a weight coefficient w. As the relationship between SD/MD and w, a line 161 is illustrated as an example.

The line 161 satisfies Formula 3 below. Here, w is monotonically non-decreasing (monotonic increase in a broad sense) with respect to SD/MD. In other words, at least w does not decrease when SD/MD increases.

[Math 3]

$$w = 0.5\left(1 - \frac{MD}{SD}\right) \qquad \text{Formula 3}$$

The signal processing unit 102 refers to such a relationship between SD/MD and weight coefficient w, to derive the weight coefficient w from SD/MD. For example, when a stereophonic audio signal collected at the event of table tennis is reproduced at a public viewing venue, 4(=10/2.5) is obtained as SD/MD. In this case, since SD/MD is greater than 1 (threshold value), for example, the signal processing unit 102 calculates w=0.375 by substituting SD/MD=4 in Formula 3.

The signal processing unit 102 then mixes the stereophonic audio signals based on the derived weight coefficient w (S122). That is, the signal processing unit 102 mixes the left-channel signal and the right-channel signal for the left speaker 20L and the right speaker 20R, based on the weight coefficient w.

The mixture of the stereophonic audio signals will be specifically described with reference to FIG. 15. FIG. 15 illustrates the second signal processing according to Embodiment 1.

Figure 15:
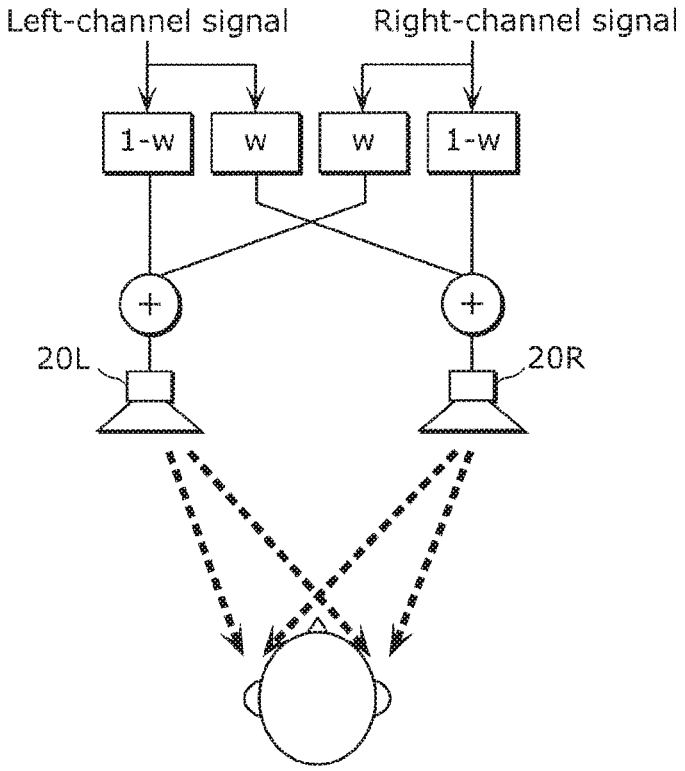
FIG. 15 illustrates the second signal processing according to Embodiment 1.

As illustrated in FIG. 15, for the left speaker 20L, the signal processing unit 102 adds the result of multiplying the right-channel signal by w to the result of multiplying the left-channel signal by 1−w. Moreover, for the right speaker 20R, the signal processing unit 102 adds the result of multiplying the left-channel signal by w to the result of multiplying the right-channel signal by 1−w. The stereophonic audio signals are mixed based on the weight coefficient w in the above manner, and the mixed signals are output from the stereo speakers 20.

By mixing the stereophonic audio signals in this way, the magnitude of the left-channel signal reaching the right ear of the listener increases, and the magnitude of the right-channel signal reaching the left ear of the listener increases. In other words, the crosstalk components of the sound output from the stereo speakers 20 are amplified, leading to a reduction in the stereo effect.

Here, the weight coefficient w increases as SD/MD increases. The mixing amount of the stereophonic audio signals increases as the weight coefficient w increases. In other words, as SD/MD increases, the crosstalk components of the sound output from the stereo speakers 20 can be amplified, allowing the stereo effect to be reduced.

[Advantageous Effects Etc.]

As described above, the sound processing device 100 according to the present embodiment includes: the distance information obtaining unit 101 which obtains information about the first distance between the stereo microphones 10 and information about the second distance between the stereo speakers 20; and the signal processing unit 102 which processes the stereophonic audio signal collected by the stereo microphones, according to the first distance and the second distance to adjust the stereo effect provided when the stereophonic audio signal is reproduced from the stereo speakers.

Accordingly, the stereo effect can be adjusted by processing the stereophonic audio signal according to the first distance and the second distance. As a result, it is possible to realize the stereo effect suitable for the sound collection environment and the reproduction environment, leading to realistic sound reproduction.

Moreover, in the sound processing device 100 according to the present embodiment, the signal processing unit 102 may perform, on the stereophonic audio signal, the first signal processing for increasing the stereo effect, when the value of the ratio of the second distance to the first distance is less than the threshold value.

Accordingly, by increasing the stereo effect when the second distance between the stereo speakers 20 is less than the first distance between the stereo microphones 10, the stereophonic audio signal can be reproduced such that the sound is heard from the direction in which the sound was collected. As a result, more realistic sound reproduction can be realized.

Moreover, in the sound processing device 100 according to the present embodiment, the first signal processing may attenuate the crosstalk components of the sound output from the stereo speakers 20.

Accordingly, the magnitude of the left-channel signal reaching the right ear of the listener can be reduced, and the magnitude of the right-channel signal reaching the left ear of the listener can be reduced. This allows an increase in the stereo effect.

Moreover, in the sound processing device 100 according to the present embodiment, in the first signal processing, the stereo effect may be increased as the value of the ratio of the second distance to the first distance decreases.

Accordingly, the stereo effect can be increased as the second distance decreases with respect to the first distance. Then, the stereophonic audio signal can be reproduced such that the sound can be heard from the direction in which the sound was collected. As a result, more realistic sound reproduction can be realized.

Moreover, in the sound processing device 100 according to the present embodiment, the signal processing unit 102 may perform, on the stereophonic audio signal, the second signal processing for reducing the stereo effect, when the value of the ratio of the second distance to the first distance is greater than the threshold value.

Accordingly, by reducing the stereo effect when the second distance between the stereo speakers 20 is greater than the first distance between the stereo microphones 10, the stereophonic audio signal can be reproduced such that the sound is heard from the direction in which the sound was collected. As a result, more realistic sound reproduction can be realized.

Moreover, in the sound processing device 100 according to the present embodiment, the second signal processing may amplify the crosstalk components of the sound output from the stereo speakers 20.

Accordingly, the magnitude of the left-channel signal reaching the right ear of the listener can be increased, and the magnitude of the right-channel signal reaching the left ear of the listener can be increased. This can reduce the stereo effect.

Moreover, in the sound processing device 100 according to the present embodiment, in the second signal processing, the stereo effect may be reduced as the value of the ratio of the second distance to the first distance increases.

Accordingly, the stereo effect can be reduced as the second distance increases with respect to the first distance. As a result, the stereophonic audio signal can be reproduced such that the sound is heard from the direction in which the sound was collected. As a result, more realistic sound reproduction can be realized.

Embodiment 2

Next, Embodiment 2 will be described. The present embodiment is different from Embodiment 1 in the first signal processing for increasing the stereo effect. Specifically, in the first signal processing according to the present embodiment, the stereo effect is adjusted based on the angle between two directions from the listener toward two virtual sound sources. Hereinafter, the present embodiment will be specifically described mainly on the differences from Embodiment 1, with reference to the drawings.

[Configuration of Sound Processing System]

A sound processing system according to the present embodiment will be described with reference to FIG. 1. The sound processing system according to the present embodiment includes a sound processing device 200 and a signal processing unit 202, instead of the sound processing device 100 and the signal processing unit 102. The other structural elements in Embodiment 2 are the same as those in Embodiment 1, and thus, the descriptions thereof are appropriately omitted.

The signal processing unit 202 performs, on a stereophonic audio signal, first signal processing for increasing the stereo effect, when the value of ratio of the second distance to the first distance (SD/MD) is less than a threshold value (Th). The signal processing unit 202 also performs, on a stereophonic audio signal, second signal processing for reducing the stereo effect, when the value of the ratio of the second distance to the first distance (SD/MD) is greater than the threshold value (Th).

In the present embodiment, the first signal processing increases the angle between two directions from the listener toward two virtual sound sources. Here, the two virtual sound sources are localized by the sound output from the stereo speakers 20.

[Operation of Sound Processing Device]

Next, an operation of the sound processing device 200 configured as described above will be described. Since the overall processing of the sound processing device 200 is substantially the same as those in FIG. 8 in Embodiment 1, illustration and description thereof are omitted.

[First Signal Processing]

Figure 16:
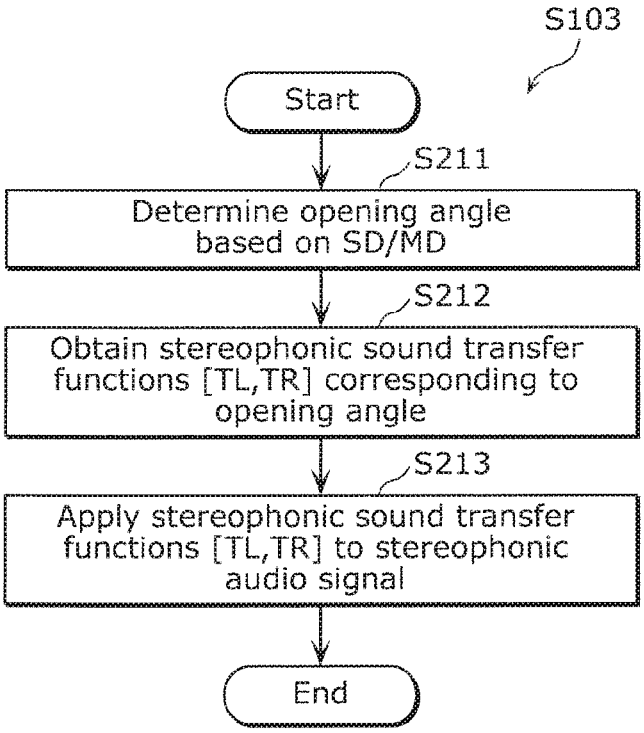
FIG. 16 is a flowchart of first signal processing according to Embodiment 2.

Here, the first signal processing will be specifically described with reference to FIG. 16. FIG. 16 is a flowchart of the first signal processing (S103) according to Embodiment 2.

As illustrated in FIG. 16, first, the signal processing unit 202 determines an opening angle which is a parameter for the first signal processing, based on SD/MD (S211). The opening angle refers to the angle between the directions of the virtual sound sources with respect to the front direction of the face of the listener. The signal processing unit 202 obtains the stereophonic sound transfer functions [TL, TR] corresponding to the determined opening angle (S212). Finally, the signal processing unit 202 applies the stereophonic sound transfer functions [TL, TR] to a stereophonic audio signal (S213).

Figure 17:
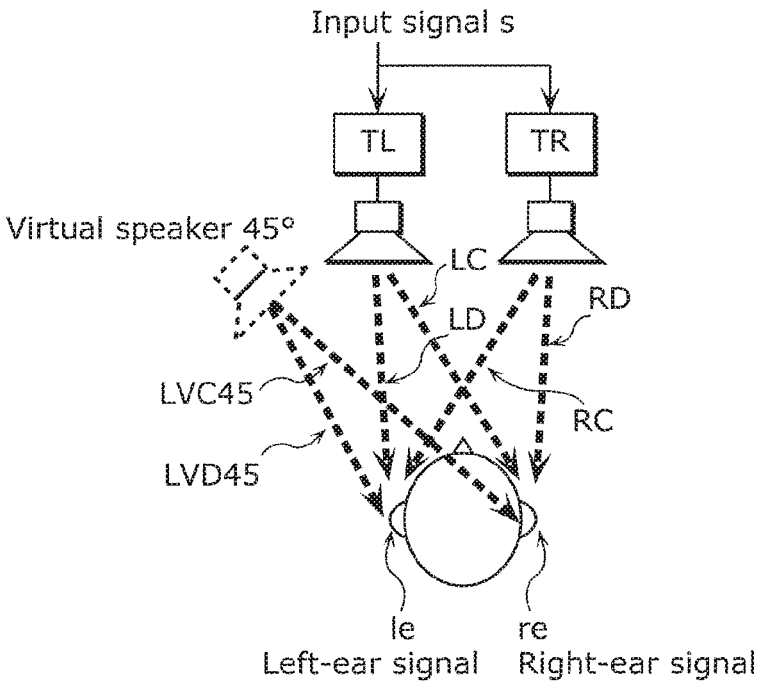
FIG. 17 illustrates principles of the first signal processing according to Embodiment 2.
Figure 18:
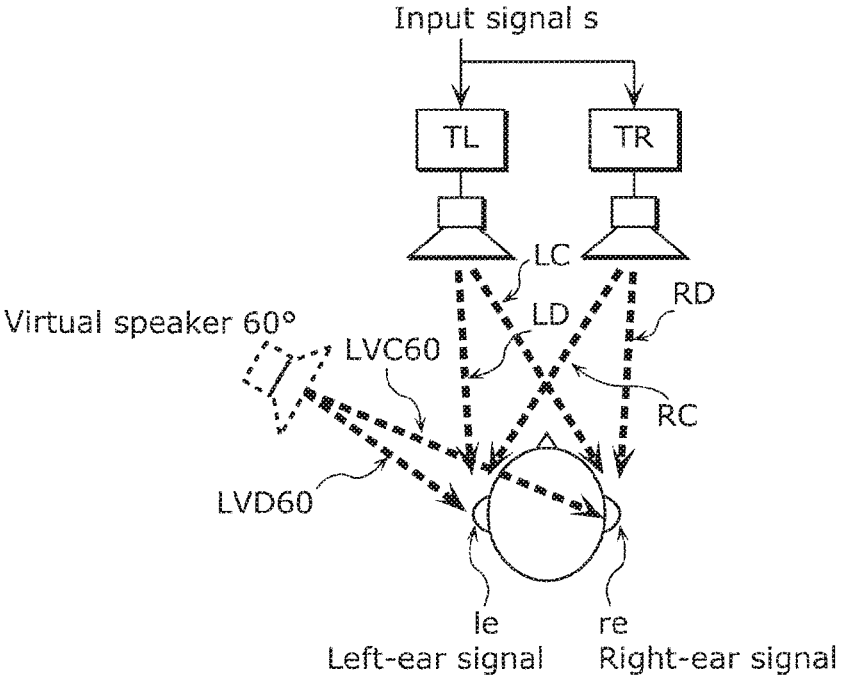
FIG. 18 illustrates principles of the first signal processing according to Embodiment 2.

Here, the opening angle and the stereophonic sound transfer functions [TL, TR] will be described with reference to FIG. 17 to FIG. 20. FIG. 17 and FIG. 18 illustrate the principles of the first signal processing according to Embodiment 2.

In FIG. 17, the virtual speaker (virtual sound source) is arranged in the direction of 45 degrees with respect to the front direction of the face of the listener. LVD 45 represents the transfer function of the sound reaching the left ear of the listener from the virtual speaker, and LVC 45 represents the transfer function of the sound reaching the right ear of the listener from the same virtual speaker.

When the opening angle is 45 degrees as described above, the opening angle of the virtual speaker is greater than the opening angle of the actual stereo speakers. This leads to an increase in the stereo effect. The stereophonic sound transfer functions [TL, TR] at this time are derived by Formula 4.

[Math 4]

$$\begin{pmatrix} TL \\ TR \end{pmatrix} = \begin{pmatrix} LD & RC \\ LC & RD \end{pmatrix}^{-1} \times \begin{pmatrix} LVD45 \\ LVC45 \end{pmatrix} \quad \text{Formula 4}$$

In FIG. 18, the virtual speaker is arranged in the direction of 60 degrees with respect to the front direction of the face of the listener. LVD 60 represents the transfer function of the sound reaching the left ear of the listener from the virtual speaker, and LVC 60 represents the transfer function of the sound reaching the right ear of the listener from the same virtual speaker.

When the opening angle is 60 degrees as described above, the opening angle of the virtual speakers is greater than the opening angle of the actual stereo speakers. This leads to an increase in the stereo effect. The stereophonic sound transfer functions [TL, TR] at this time are derived by Formula 5.

[Math 5]

$$\begin{pmatrix} TL \\ TR \end{pmatrix} = \begin{pmatrix} LD & RC \\ LC & RD \end{pmatrix}^{-1} \times \begin{pmatrix} LVD60 \\ LVC60 \end{pmatrix} \quad \text{Formula 5}$$

In the present embodiment, the signal processing unit 202 stores, for example, information associating a plurality of opening angles with a plurality of stereophonic sound transfer functions. In this case, the signal processing unit 202 is capable of obtaining the stereophonic sound transfer functions corresponding to the opening angle determined in step S211, by referring to the stored information.

Figure 19:
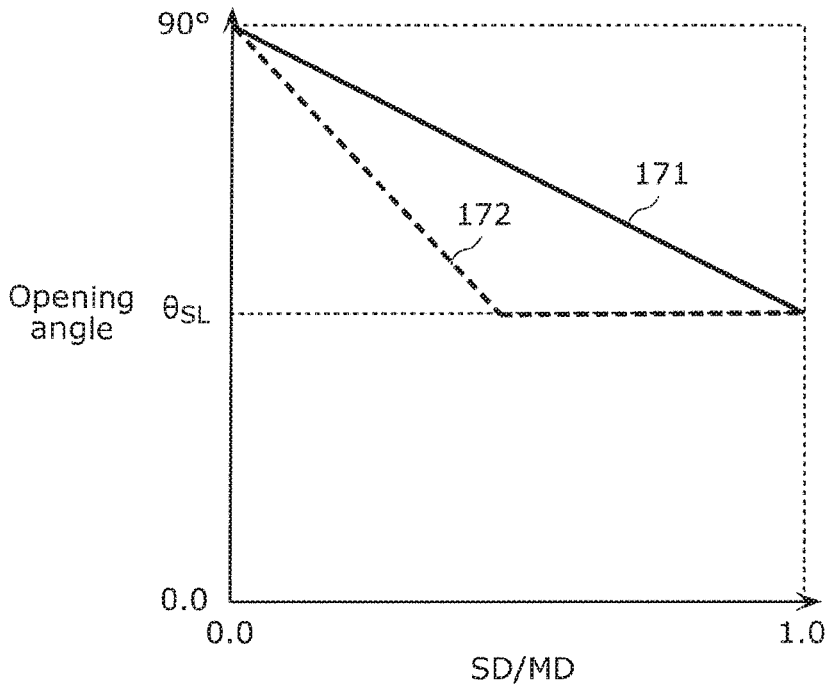
FIG. 19 is a graph of an example of a relationship between SD/MD and parameter used for the first signal processing according to Embodiment 2.

FIG. 19 is a graph of an example of a relationship between SD/MD and parameter for the first signal processing according to Embodiment 2. In FIG. 19, the horizontal axis indicates SD/MD, and the vertical axis indicates an opening angle which is a parameter. As a relationship between SD/MD and opening angle, two examples of a line 171 and a line 172 are indicated.

In the line 171, the opening angle and SD/MD are in a proportional relationship. When SD/MD is "0", the opening angle is 90 degrees, and when SD/MD is "1", the opening angle is $\theta_{SL}$.

In contrast, in the line 172, when SD/MD is less than b (0<b<1), the opening angle is proportional to SD/MD, and when SD/MD is greater than or equal to b, the opening angle takes a constant value ($\theta_{SL}$) regardless of SD/MD.

In both cases of the line 171 and the line 172, the opening angle is monotonically non-increasing (monotonic decrease in a broad sense) with respect to SD/MD. In other words, the opening angle does not increase at least when SD/MD increases. In such a case, as SD/MD decreases, it is possible to increase the opening angle, leading to an increase in the stereo effect.

Figure 20:
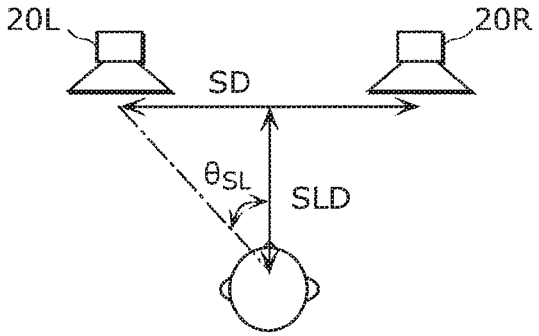
FIG. 20 illustrates parameter according to Embodiment 2.

Here, $\theta_{SL}$ will be described with reference to FIG. 20. As illustrated in FIG. 20, $\theta_{SL}$ corresponds to the opening angle of the actual left speaker 20L and right speaker 20R, and is determined by the position of the listener, and the positions of the left speaker 20L and the right speaker 20R. $\theta_{SL}$ can be obtained by Formula 6 below.

[Math 6]

$$\theta_{SL} = \tan^{-1}\left(\frac{SD/2}{SLD}\right) \quad \text{Formula 6}$$

Here, SLD represents the distance between the listener and the stereo speakers 20 in the direction orthogonal to the line connecting the left speaker 20L and the right speaker 20R. SLD is a value assumed in advance according to the reproduction environment. Information about the SLD may be obtained in a similar manner to the information about MD and SD.

It should be noted that the relationship between SD/MD and the opening angle is not limited to the lines 171 and 172 in FIG. 19. For example, the opening angle of the stereo speakers may be obtained so as to match the positional relationship between the stereo microphones in the event venue and the listener.

[Advantageous Effects Etc.]

As described above, in the sound processing device 200 according to the present embodiment, the first signal processing increases the angle between two directions from the listener toward two virtual sound sources. The two virtual sound sources are localized by the sound output from the stereo speakers 20.

Accordingly, when the second distance between the stereo speakers 20 is less than the first distance between the stereo microphones 10, the directions of two virtual sound sources can be brought close to the directions in which the stereophonic audio signal was collected. As a result, more realistic sound reproduction can be realized.

OTHER EMBODIMENTS

Although the sound processing device according to one or more aspects of the present disclosure has been described based on the embodiments, the present disclosure is not limited to those embodiments. Various modifications of the exemplary embodiments as well as embodiments resulting from combinations of structural elements of different exemplary embodiments that may be conceived by those skilled in the art may be included within the scope of one or more aspects of the present disclosure as long as these do not depart from the essence of the present disclosure.

For example, the sound processing device may combine the first signal processing of the first embodiment and the first signal processing of the second embodiment. In other words, both the parameter β and the opening angle may be adjusted in the first signal processing. For example, when the opening angle is determined to be 45 degrees according to SD/MD, it may be that, in the above formula 4, the stereophonic sound transfer functions [TL, TR] are derived by multiplying LVC45 by β determined according to SD/MD, and multiplying LVD45 by α (=1−β). Moreover, for example, when the opening angle is determined to be 60 degrees according to SD/MD, it may be that, in the above Formula 5, the stereophonic sound transfer functions [TL, TR] are derived by multiplying LVC60 by β determined according to SD/MD, and multiplying LVD60 by α (=1−β).

In each of the above embodiments, the first signal processing is performed when SD/MD is less than the threshold value, and the second signal processing is performed when SD/MD is greater than the threshold value. However, both the first signal processing and the second signal processing do not always have to be performed. For example, it may be that the first signal processing is performed when SD/MD is less than the threshold value, and the second signal processing does not have to be performed when SD/MD is greater than the threshold value. In contrast, it may be that the first signal processing is not performed when SD/MD is less than the threshold value, and the second signal processing is performed when SD/MD is greater than the threshold value. Even in such a case, when SD is less than MD or when SD is greater than MD, it is possible to realize the stereo effect suitable for the sound collection environment and the reproduction environment.

In the above embodiments, the stereophonic audio signal is processed such that the left and right virtual sound sources are arranged symmetric about the listener. However, the arrangement of the left and right virtual sound sources may be asymmetric.

In each of the embodiments above, parameters are determined based on SD/MD in the first signal processing, however, the parameters do not have to be determined. For example, stereophonic sound transfer functions may be derived directly from SD/MD. In this case, it is sufficient that information which associates a plurality of stereophonic sound transfer functions with a plurality of SD/MD is stored in advance.

Although the opening angle is used in the first signal processing in Embodiment 2, the opening angle may also be used in the second signal processing to adjust the stereo effect. For example, the opening angle may be determined to be less than $\theta_{SL}$ in the second signal processing. This can make the opening angle of the virtual speakers less than the opening angle of the actual left speaker 20L and right speaker 20R. As a result, the stereo effect can be reduced.

A portion or all of the structural elements included in the sound processing device according to each embodiment described above may be configured from one system large scale integration (LSI). For example, the sound processing device 100 may be configured from a system LSI including the distance information obtaining unit 101 and the signal processing unit 102.

A system LSI is a super-multifunction LSI manufactured with a plurality of structural elements integrated on a single chip. The system LSI is specifically a computer system configured of a microprocessor, a read only memory (ROM), and a random-access memory (RAM), for example. The ROM stores a computer program. The system LSI achieves its function as a result of the microprocessor operating according to the computer program.

The system LSI is described here, but it may also be referred to as an integrated circuit (IC), a LSI, a super LSI or an ultra LSI depending on the degree of integration. Moreover, the circuit integration technique is not limited to LSI, and may be realized by a dedicated circuit or a general-purpose processor. After manufacturing of the LSI circuit, a programmable field programmable gate array (FPGA) or a reconfigurable processor which is reconfigurable in connection or settings of circuit cells inside the LSI circuit may be used.

Further, when development of a semiconductor technology or another derived technology provides a circuit integration technology which replaces LSI, as a matter of course, functional blocks may be integrated by using this technology. Adaption of biotechnology, for example, is a possibility.

The structural elements included in the sound processing device according to each embodiment described above may be separately included in a plurality of devices interconnected via a communication network.

Moreover, an aspect of the present disclosure may be not only such a sound processing device, but also a sound processing method including, as steps, the characteristic structural elements included in the sound processing device. Moreover, an aspect of the present disclosure may be a computer program causing a computer to execute the characteristic steps included in the sound processing method. Moreover, an aspect of the present disclosure may also be a non-transitory computer-readable recording medium on which this sort of computer program is recorded.

Each of the structural elements in each of the above-described embodiments may be configured in the form of an exclusive hardware product, or may be realized by executing a software program suitable for the structural element. Each of the structural elements may be realized by means of a program executing unit, such as a CPU and a processor, reading and executing the software program recorded on a recording medium such as a hard disk or a semiconductor memory. Here, the software program for realizing the sound processing device or the like according to each of the embodiments is a program described below.

In other words, the program causes a computer to execute a sound processing method which includes: obtaining information about a first distance between stereo microphones and information about a second distance between stereo loudspeakers; processing a stereophonic audio signal collected by the stereo microphones according to the first distance and the second distance to adjust the stereo effect provided when the stereophonic audio signal is reproduced from the stereo loudspeakers.

INDUSTRIAL APPLICABILITY

The sound processing device according to the present disclosure is applicable to a reception terminal and the like used for sports relay broadcast.

The invention claimed is:

1. A sound processing device, comprising:

an obtaining unit configured to obtain information about a first distance between stereo microphones and information about a second distance between stereo loudspeakers; and a signal processing unit configured to process a stereophonic audio signal according to the first distance and the second distance to adjust a stereo effect provided when the stereophonic audio signal is reproduced from the stereo loudspeakers, the stereophonic audio signal being collected by the stereo microphones, wherein the signal processing unit is configured to perform first signal processing on the stereophonic audio signal, when a value of a ratio of the second distance to the first distance is less than a threshold value, the first signal processing increasing the stereo effect.

2. The sound processing device according to claim 1, wherein the first signal processing attenuates a crosstalk component of sound output from the stereo loudspeakers.

3. The sound processing device according to claim 1, wherein the first signal processing increases an angle between two directions from a listener to two virtual sound sources, and the two virtual sound sources are localized by sound output from the stereo loudspeakers.

4. The sound processing device according to claim 1, wherein the first signal processing increases the stereo effect as the value of the ratio of the second distance to the first distance decreases.

5. The sound processing device according to claim 1, wherein the obtaining unit is configured to obtain the information about the first distance via a medium.

6. The sound processing device according to claim 5, wherein the information about the first distance and the information about the second distance include an event type which is a type of a sporting event in which the stereo microphones are arranged, and the obtaining unit is configured to obtain the first distance corresponding to the event type included in the information about the first distance and the information about the second distance, by referring to event distance information which associates the event type and the first distance.

7. The sound processing device according to claim 5, wherein the information about the first distance and the information about the second distance include a value of the first distance.

8. The sound processing device according to claim 1, wherein the first distance is predetermined according to a length of an offensive and defensive direction in a playing area of a sporting event.

9. The sound processing device according to claim 1, wherein the stereo loudspeakers are arranged in a public viewing venue of a sporting event.

10. The sound processing device according to claim 1, wherein the stereo loudspeakers are included in a mobile terminal.

11. The sound processing device according to claim 1, wherein the stereo loudspeakers are included in a television receiver.

12. A sound processing device, comprising:

an obtaining unit configured to obtain information about a first distance between stereo microphones and information about a second distance between stereo loudspeakers; and a signal processing unit configured to process a stereophonic audio signal according to the first distance and the second distance to adjust a stereo effect provided when the stereophonic audio signal is reproduced from the stereo loudspeakers, the stereophonic audio signal being collected by the stereo microphones, wherein the signal processing unit is configured to perform second signal processing on the stereophonic audio signal, when a value of a ratio of the second distance to the first distance is greater than a threshold value, the second signal processing reducing the stereo effect.

13. The sound processing device according to claim 12, wherein the second signal processing amplifies a crosstalk component of sound output from the stereo loudspeakers.

14. The sound processing device according to claim 12, wherein the second signal processing reduces the stereo effect as the value of the ratio of the second distance to the first distance increases.

15. A sound processing method, comprising:

obtaining information about a first distance between stereo microphones and information about a second distance between stereo loudspeakers; and processing a stereophonic audio signal according to the first distance and the second distance to adjust a stereo effect provided when the stereophonic audio signal is reproduced from the stereo loudspeakers, the stereophonic audio signal being collected by the stereo microphones, the processing a stereophonic audio signal comprises performing first signal processing on the stereophonic audio signal, when a value of a ratio of the second distance to the first distance is less than a threshold value, the first signal processing increasing the stereo effect.

16. A non-transitory computer-readable recording medium for use in a computer, the recording medium having a computer program recorded thereon for causing the computer to execute the sound processing method according to claim 15.

* * * * *